US006057072A

United States Patent [19]

Guistina et al.

[11] Patent Number: 6,057,072

[45] **Date of Patent: *May 2, 2000**

[54] TONER COMPOSITIONS CONTAINING ACTIVATED CARBONS

[75] Inventors: Robert A. Guistina, Rochester; Dinesh Tyagi, Fairport, both of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/829,014

[22] Filed: Mar. 31, 1997

[51] Int. Cl.[7] ..... G03C 9/09

[52] U.S. Cl. ..... 430/106; 430/110; 430/137

[58] Field of Search ..... 430/106, 137, 430/110; 524/496

[56] References Cited

U.S. PATENT DOCUMENTS

| | | | |
|---|---|---|---|
| 3,850,663 | 11/1974 | Hagenbach | 252/62.1 |
| 3,970,571 | 7/1976 | Olson et al. | 427/212 |
| 4,517,272 | 5/1985 | Jadwin et al. | 430/110 |
| 4,546,060 | 10/1985 | Miskinis et al. | 403/108 |
| 4,590,140 | 5/1986 | Mitsuhashi et al. | 430/102 |
| 4,758,491 | 7/1988 | Alexandrovioch et al. | 430/109 |
| 4,833,060 | 5/1989 | Nair et al. | 430/137 |
| 4,912,009 | 3/1990 | Amering et al. | 430/137 |
| 4,965,131 | 10/1990 | Nair et al. | 428/407 |
| 4,982,034 | 1/1991 | Moore et al. | 585/436 |
| 5,192,637 | 3/1993 | Saito et al. | 430/110 |
| 5,523,484 | 6/1996 | Wilson et al. | 430/110 |

FOREIGN PATENT DOCUMENTS

| | | | |
|---|---|---|---|
| 0555022 | 8/1993 | European Pat. Off. | 430/137 |
| 61-203463 | 9/1986 | Japan | 430/106 |
| 2-171759 | 7/1990 | Japan . | |
| 4-338970 | 11/1992 | Japan . | |
| 2003885 | 3/1979 | United Kingdom | 430/137 |

OTHER PUBLICATIONS

Patent & Trademark Office English–Language Translation of JP 2–171759 (Pub Jul. 1990).

Diamond, A.S. et al. Handbook of Imaging Materials, Marcel Dekker, Inc., NY (1991), pp. 193–195.

Patent & Trademark Office English–Language Translation of JP 61–203463 (Pub Sep. 1986).

Patent & Trademark Office English–Language Translation of JP 4–338970 (Pub Nov. 1992).

Gas Abstract AN 1987:147090 of Japanese Patent 61–203463 (Pub Sep. 1986).

Derwent Abstract 86–276639/42 of Japanese Patent 61–203463 (Pub Sep. 1986).

U.S. application No. 08/736,098, Sorriero et al., filed Oct. 24, 1996.

*Activated Carbon*, J. Mattson and H. Clark, Marcel Decker Inc. NY, 1971, pp. 9–23, 38–47.

*Primary Examiner*—Janis L. Dote
*Attorney, Agent, or Firm*—Doreen M. Wells

[57] ABSTRACT

A process for making toners substantially free from odors originating from components used in the toner formulation is disclosed. The process involves mixing the toner composition with activated carbon. A composition for odor-free toners also disclosed.

16 Claims, No Drawings

TONER COMPOSITIONS CONTAINING ACTIVATED CARBONS

FIELD OF THE INVENTION

This invention relates to electrostatography, and more particularly to toner compositions for electrostatographic image development methods.

BACKGROUND OF THE INVENTION

In electrostatography, an image comprising a pattern of electrostatic potential (also referred to as an electrostatic latent image), is formed on a surface of an electrophotographic element and is then developed into a toner image by contacting the latent image with an electrographic developer. If desired, the latent image can be transferred to another surface following development. The toner image may be transferred to a receiver, to which it is fused, typically by heat and pressure.

Toners contain a binder and other optional additives, such as colorants and charge control agents. Electrostatographic toners are commonly made by polymerization of a binder followed by mixing the binder polymer with various additives and then grinding to a desired size range.

The toner binder has a number of characteristics which are influenced by its molecular weight and its architecture. For example, the molecular weight distribution and degree of branching or crosslinking directly affect toner properties such as melt viscosity, melt elasticity, toner keeping, photoconductor scumming, fusing and grinding characteristics. Therefore, it is desirable to control the molecular weight and molecular architecture of electrophotographic binder polymers quite precisely.

One of the most effective ways to achieve control over molecular weight and chain architecture is through the well-known use of mercaptan-type (RSH) chain-transfer agents which are added directly to the monomer mixture prior to initiation of the polymerization reaction. These types of chain-transfer agents possess high transfer coefficients (Cs) for styrene-based systems. They provide excellent control over polymer molecular weight and branching when they are used in conjunction with a crosslinking agent such as divinylbenzene.

The use of RSH-type chain-transfer agents suffers from a significant drawback. The mercaptan groups are incorporated into the polymer chains mainly as sulfide. In toner manufacture the binder polymers are subjected to high temperatures and shear resulting in degradation of the long polymer chains. This phenomenon leads to the regeneration of free thiol compounds from the chain ends as well as other thiol-containing species. Some of these thermally-generated species are low enough in molecular weight to possess appreciable vapor pressures both at ambient temperatures and particularly when present in high-heat areas of electrophotographic copiers such as fusing stations.

Since these thiols and/or sulfide compounds have strong, objectionable odors typical of most sulfur compounds, their presence as impurity in the toner is not desirable. These sulfur compounds can have odor thresholds as low as 2 parts per billion. Additionally, these thermally-generated thiol compounds can further be oxidatively degraded to yield sulfur dioxide ($SO_2$) which is a highly volatile, malodorous gas.

Further, the preparation of commercial toner binder polymers often involves the addition polymerization of volatile vinylic compounds in the presence of suitable free radical initiators and molecular weight distribution modifiers as further discussed below. Suitable vinylic compounds for toner binder synthesis include, but are not limited to, a combination of styrene, vinyl toluene, t-butyls-tyrene, butyl acrylate, butyl methacrylate, iso-butyl methacrylate, 2-hydroxyethyl methacrylate, acrylic acid, methacrylic acid and may furthermore be crosslinked with suitable tetrafunctional vinylic moieties such as divinyl benzene to further augment desirable toner binder properties.

If these monomers are polymerized into the high molecular weight polymer chain then their vapor pressure essentially drops to zero. However, if as is most often the case, conversion of vinyl monomer to polymer is incomplete then the resulting binder polymer will suffer from a substantial odor problem caused by the presence of all the volatiles resulting from unpolymerized vinyl, acrylate and methacrylate monomers.

The styrenic moieties styrene, vinyl toluene, t-butylstyrene have particularly objectionable odors with very low thresholds of olfactory detection. These odors can be substantially aggravated in the heated zones of copiers such as in fusing stations. Odor thresholds for these compounds are so low that conventional methods of polymer purification such as solvent washing, reprecipitation, slurrying etc., cannot provide odor-free toner binder.

The toner composition generally also comprises optional addenda with various functions. For example, charge control agents are typically used in toner compositions to provide the desired charge level as well as to provide charge stability over a long developer life. Various pigments and dyestuffs are also used to provide the preferred hue and hiding power to the marking toner. Further, various low molecular weight polyolefins and aliphatic amines or aliphatic acids or salts thereof are used very commonly to provide release characteristics to the toner from the fuser roller surface etc. All such additives and other optional additives not mentioned above have their characteristic odor which are often quite objectionable when toners comprising them are fused by the application of heat. Often, the odor is easily detectable when a stored toner bottle is opened prior to placing it in the copier.

What is needed, then, is a product and/or process of eliminating the objectionable odors associated with vinyl addition polymerization especially in the presence of mercaptan-mediated chain-transfer agents and other optional toner additives.

SUMMARY OF THE INVENTION

The present invention provides a method of preparing an odor-free toner comprising the steps of:

a) mixing a binder polymer and an activated carbon;

b) melt blending the polymer and activated carbon to achieve a uniformly blended melt product;

c) cooling the melt product; and d) pulverizing the melt product to the desired volume average particle size.

In another aspect of the invention, there is provided a toner comprising a binder polymer and particles of activated carbon suspended therein.

The process and composition of the invention provide toners substantially free from odors originating from components used in the toner formulation.

DETAILS OF THE INVENTION

The toner composition of the invention comprises a binder polymer and activated carbon. These two components, as well as other optional useful toner additives described hereinafter, are well known in the art and any example of these components may be used in the practice of this invention. Invariably, these components make the toner composition malodorous.

Activated carbons are incorporated directly into the toner formulations to react with or physically adsorb the volatile vinylic monomers, the thermally-generated mercaptans, and other odor-causing species associated with other optional toner additives. It appears that these carbonaceous adsorbents form thermally stable, non-volatile, species with the odor-causing species, thus eliminating the emission of odor. The mechanism by which the carbonaceous substance mordants the odor-causing species is not known. Since the carbonaceous substance is added to the toner formulation, the polymer manufacturing process is not perturbed in any way, but the objectionable odors are eliminated.

The term "activated" carbon generally refers to highly porous carbonaceous materials which are capable of chemically or physically adsorbing certain species from dilute solution either in the gas or liquid phase. "Activation" is basically the development of pores in a non-porous raw material by means of chemical reaction. The very large porosity provides a large surface area, which results in exceptional absorptive properties. Regardless of the preparative process, the key parameter in activating a carbon surface is oxidation of that surface and how this oxidation is carried out. The carbons are typically oxidized at temperatures in excess of 200° C. in oxidizing atmospheres ($O_2$, $CO_2$, $H_2O$) where the oxidant is in the gas phase. Depending on the specific oxidant and the method, a variety of polar, reactive functional groups may be introduced on the carbon surface. Reactive groups such as carboxy, phenolic, quinone, hydroquinone and ester have been suggested to be present on the surface of activated carbons. See, *Activated Carbon*, J. Mattson and H. Clark, Marcel Decker Inc. NY, 1971 p. 39.

It is these polar, reactive functional groups which give the carbons their "activity" in adsorbing various substances. Activated carbons have been successfully produced from a wide variety of substances including, but not limited to, coconut shells, peach pits, bone char, wood char, peat, lignite, coal, coffee grounds, molasses, rice hulls, fish, lignin and petroleum coke.

Materials such as produced by American Norit Company Inc. from vegetable matter (peat) with steam activation/oxidation and similar materials manufactured by Westvaco Corp., have proven to be particularly attractive in our invention.

In U.S. Pat. No. 4,982,034 (Amoco Corp., 1/1/91), Moore et al. taught that certain carbonaceous substances, or more specifically NORIT™ activated carbons, were effective in removing tetrafunctional impurities from t-butylstyrene. They added the activated carbon to a liquid phase (the t-butylstyrene) at room temperature or below and adsorbed the tetrafunctional impurities onto the carbon surface. Our studies found that this process is not specific to the tetrafunctional impurities but that vinylic monomers are also efficiently adsorbed to the activated carbon surface. The mechanism of adsorption and binding of the monomer to the carbon surface is not understood. Although Moore et al. adsorbed tetrafunctional impurities from a liquid phase onto the solid adsorbent at low temperature we found that activated carbons are effective in adsorbing vinyl monomers from toner polymer binders under extrusion conditions at high temperatures, i.e., over 200° C. By judicious choice of activated carbon we have discovered that toners without any odor from residual vinylic and other impurities can be prepared under typical melt extrusion conditions (70–250° C.) used in electrostatographic toner production. Quite unexpectedly, we discovered that the activated carbons were also effective in eliminating the objectionable odor from the mercaptan chain transfer agents as well as the odor found in many toner additives.

"Activated" carbons are to be distinguished from pigment or colorant carbons which may optionally be used in this invention. Pigment carbons are generally not chemically surface activated carbons and are present in our toner solely as the black colorant to give the toner tinctorial strength and contrast with the paper substrate. Examples of such would be BLACK PEARLS 430, REGAL 330R, REGAL 660R, ELFLEX 8 (all available from Cabot Corporation, Mass.), RAVEN 850, and RAVEN 1255 (all available from Columbian Chemical Co., Ga.). These types of nonactivated carbons do not control toner odors. In contrast, activated carbons do control toner odors. However, these activated carbons do not have a very high tinctorial strength and as a result have a poor hiding power.

In general, adequate amounts of activated carbon need to be incorporated so that odor elimination is complete. The amount of activated carbon required for eliminating the undesired odor ranges from about 1 to 5, and preferably 1 to 2 weight percent of the total toner weight. No additional improvement in odor was observed when higher levels of activated carbon were utilized. The activated carbon can be incorporated into the toner formulation in a variety of ways; for example, it may be used as is in the toner formulation process. Typically, activated carbons which are commercially available, consist of particles which are greater than 10 microns. In some cases they are several millimeters in diameter. For the purpose of incorporating these activated carbons in a toner formulation, it is desirable to have activated carbons particles which are smaller than the final toner particles. If the selected activated carbon does not break down to smaller particle size during the melt compounding operation of toner manufacturing, then it would be necessary to mill or break it down into smaller particles by well known techniques. Particles of activated carbons could be either dry milled or milled in solution or even dispersed in a molten polymer matrix prior to being used in the toner formulation.

The desired polymeric binder for toner application is first produced. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt blending of toner addenda into the bulk of the polymer.

The polymer used in the examples of this invention is made using a limited coalescence reaction. "Limited coalescence polymerization" is a relatively broad term that refers to both emulsion and suspension polymerizations.

The polymers used in the examples of this invention were prepared using the suspension polymerization procedure disclosed in U.S. Pat. No. 4,912,009 to Amering et al. The water insoluble reactants: monomer, crosslinker, initiator and chain transfer agent are mixed together and then dispersed into an aqueous medium containing a water-dispersible, but water-insoluble suspending agent.

The suspending agent or stabilizer is a negatively charged, solid colloidal material such as clay or colloidal silica. The suspending agent is used with a water soluble "promoter" that affects the hydrophobic-hydrophilic balance of the solid colloidal particles by forming a complex with the suspending agent. The promoter has both hydrophilic and hydrophobic groups and reduces the hydrophilicity of the suspending agent. It is believed that the promoter drives the particle of the solid colloid to the liquid-liquid interface of the oleophilic monomer droplets and the aqueous phase.

The colloidal particles have dimensions from about 1 to 100 nanometers and preferably from about 5 to 70 nanometers. The size and concentration of these particles largely control the size of the polymer particles.

Hydrophilic colloidal silica useful as the suspending agent is available commercially, for example, under the trade names and in the particle sizes as follows: LUDOX TM, 20 nm; LUDOX HS-40, 12 nm; LUDOX SM, 7 nm; and LUDOX AM, 12 nm; all supplied by E. I. du Pont de Nemours Company; and NALCOAG 1060, 60 nm supplied by Nalco Chemical Co.

A material useful as the promoter is a condensation product of about 2 to 6 carbon alkyl dicarboxylic acid and an alkanol amine. A current preferred diacid is adipic acid. It is currently preferred that the alkanol groups of the alkanol amine have from about 1 to 4 carbons. Particularly preferred are diethanolamine and methyl amino ethanol. With adipic acid, these form polymers that complex with hydrophobic silica and then coat the hydrophilic droplets.

It is also desirable that a water soluble material be added that prevents polymerization in the aqueous phase. Examples of such materials are: sodium nitrate, copper salts, methylene blue, and phenols. A currently preferred material is potassium dichromate.

The free radical initiator is soluble in the mixture of monomer, crosslinker, and chain transfer agent. Examples of such initiators include azo compounds such as 2,2'-azobis-(2-methylbutyronitrile), 2,2'-azobis(isobutyroni-trile). Commercially available products include: VAZO 67, VAZO 64, and VAZO 52 marketed by du Pont.

In a particular embodiment of the method of the invention, the monomer, crosslinker, chain transfer agent, and initiator are first combined to provide an initial reaction mixture which is then added to an aqueous dispersion of the stabilizing agents. The initial reaction mixture is added to the aqueous mixture with high shearing agitation to a obtain a suspension of monomer droplets. The high shearing forces reduce the size of the monomer droplets. An equilibrium is reached in which the size of the droplets is stabilized or limited by the suspending agent complex which coats the surfaces of the droplets.

The mixture is then heated and stirred in the reaction vessel to polymerize the monomer droplets. The resulting polymer beads are isolated by filtration and can, if desired, be slurried with water to remove water-soluble impurities and free suspending agent complex. No extensive washing or other purification is needed.

The polymer is the polymerization product of vinyl type monomer, crosslinker, and chain transfer agent. The relative concentrations of crosslinker and chain transfer agent can be varied over a considerable range as discussed below; however, there are minimum concentrations of these two ingredients in the particulates of the invention. The crosslinker has a concentration, in the reaction mixture and the polymer produced, greater than about 0.2 parts by weight per 100 parts by weight of the monomer. The total concentration of both crosslinker and chain transfer agent is greater than about 0.4 parts by weight per hundred parts of monomer. Unless crosslinker and chain transfer agent are at these concentrations or higher, characteristics of the particulate produced, such as degree of branching and/or gel concentration, varies widely with small changes in concentration of crosslinker or chain transfer agent or equipment size or conditions. These very narrow tolerances are unacceptable for manufacturing scale processes can destroy or greatly diminish the practical usefulness of such materials. In currently preferred embodiments of the invention, having greater tolerances for concentration inaccuracies, the crosslinker has a concentration of at least 0.2 parts per hundred parts of monomer and the chain transfer agent has a concentration of at least 0.2 parts per hundred parts of monomer.

Certain monomers are preferred, namely styrene and butyl acrylate. Examples of other suitable monomers include t-butyl styrene, alpha-methylstyrene, para-chlorostyrene, and vinyl toluene; and an alkyl acrylate or methacrylate or monocarboxylic acids having a double bond is selected from the group consisting of acrylic acid, methyl acrylate, 2-ethylhexyl acrylate, 2-ethylhexyl methacrylate, ethyl acrylate, butyl acrylate, dodecyl acrylate, octyl acrylate, phenyl acrylate, methacrylic acid, methyl methacrylate, ethyl methacrylate, butyl methacrylate and octyl methacrylate.

In a currently preferred embodiment the largest component of the monomer composition is styrene or a styrene homologue such as methyl styrene. It is preferred that the styrene monomer be used in an amount of at least about 60 weight percent and more preferably at least about 75 weight percent of the monomer composition. The composition also contains at least one alkyl acrylate or methacrylate. Preferably, this is a lower alkyl acrylate or methacrylate, in which the alkyl group contains from 1 to about 4 carbon atoms.

The crosslinker contains one or more compounds each having two or more double bonds capable of polymerization. Examples of suitable crosslinkers include: aromatic divinyl compounds such as divinyl benzene, and divinyl naphthalene; carboxylic acid esters having two double bonds such as ethylene glycol diacrylate, ethylene glycol dimethacrylate, and 1,3-butane diol dimethylacrylate; divinyl compounds such as divinyl aniline, divinyl ether, divinyl sulfide, and divinyl sulfone; and compounds having three or more vinyl groups.

The chain transfer agent acts a chain terminator in the polymerization process. Suitable chain transfer agents include: mercaptans such as t-dodecanethiol, laurylmercaptan, and butylmercaptan.

Many other polymers have been reported in the literature as being useful in dry electrostatographic toners. Polymer binders useful in toners other than addition polymerized vinyl polymers are condensation polymers such as polyesters and copolyesters. Also especially useful are polyesters of aromatic dicarboxylic acids with one or more aliphatic diols, such as polyesters of isophthalic or terephthalic acid with diols such as ethylene glycol, cyclohexane dimethanol and bisphenols.

Another useful binder polymer composition comprises a copolymer of a substituted vinyl aromatic monomer; a second monomer selected from the group consisting of conjugated diene monomers and acrylate monomers selected from the group consisting of alkyl acrylate monomers and alkyl methacrylate monomers; and a third monomer which is a crosslinking agent. Binder polymer compositions of this type are described in U.S. application Ser. No.

08/736,098 filed Oct. 24, 1996, now abandoned, and entitled TONER BINDER HAVING AN ALKYL SUBSTITUTED VINYL AROMATIC MONOMER and filed in the names of Sorriero, Tyagi, Alexandrovich and Guistina.

Binder materials that are useful in the toner used in the method of this invention can be amorphous or semicrystalline polymers. The amorphous toner binder compositions would have a Tg in the range of about 45° C. to 120° C., and often about 50° C. to 70° C. The useful semi-crystalline polymers would have a Tm in the range of about 50 to 150° C. and more preferably between 60° C. and 125° C. Such polymers can be heat-fixed to film supports as well as to more conventional substrates, such as paper, without difficulty. The thermal characteristics, such as Tg and Tm, can be determined by any conventional method, e.g., differential scanning calorimetry (DSC).

Typically, the polymer binder/activated carbon composition used in this invention can be melt processed in a two roll mill or extruder. This procedure can include melt blending of other materials with the polymer, such as optional toner addenda. A preformed mechanical blend of particulate polymer particles, colorants and other toner additives can be prepared and then roll milled or extruded. The roll milling, extrusion, or other melt processing is performed at a temperature sufficient to achieve a uniformly blended composition. The resulting material, referred to as a melt product or melt slab is then cooled. For a polymer having a Tg in the range of 50° C. to 120° C., or a Tm in the range of 65° C. to 200° C., a melt blending temperature in the range of about 70° C. to about 250° C. is suitable using a roll mill or extruder. Melt blending times, that is, the exposure period for melt blending at elevated temperature, are in the range of 1 to 60 minutes.

The melt product is cooled and then pulverized to a volume average particle size of from 5 to 20 micrometers, and more preferably 7–14 micrometers, to yield a particulate of the invention. It is generally preferred to first grind the melt product prior to a specific pulverizing operation. The grinding can be carried out by any convenient procedure. For example, the solid composition can be crushed and then ground using, for example, a fluid energy or jet mill, as is known in the art, and can then be classified to remove the fines and/or to remove the coarse particles by methods well known to those skilled in the art.

The toner compositions of the invention can also be made with the evaporative limited coalescence process described in U.S. Pat. No. 4,833,060, the disclosure of which is hereby incorporated by reference. This method of making toner is especially useful when a polymer binder is selected which cannot be pulverized by most conventional procedures due to their toughness, but can be dissolved in a suitable solvent. In the limited coalescence process, binder polymer is dissolved in a water immiscible organic solvent along with optional charge control agent and pigment if needed and then a water suspension of small droplets of the binder solution are dispersed in water with a stabilizer such as silica. The water immiscible organic solvent is then removed so as to produce a suspension of monodisperse particles of the binder. The water is then removed and the toner composition recovered. The U.S. Pat. No. 4,833,060 discloses the use of a promoter and a silica stabilizer during the process. The silica can be removed by a KOH or HF wash. A polymeric latex can be used as a stabilizer and this is described in U.S. Pat. No. 4,965,131.

In order to prepare toner compositions of this invention by limited coalesecnce process of U.S. Pat. No. 4,833,060 described above, it might be necessary to include a preliminary step wherein the activated carbon is either dispersed or milled in a solution of an appropriate dispersant or binder polymer so as to form a suspension or dispersion of fine particles of the activated carbon which are smaller than the aim toner particle size. This helps to produce toners wherein the activated carbon is uniformly distributed in the polymer binder.

Numerous colorant materials selected from dyestuffs or pigments can be employed in the toners used in the invention, if needed. Such materials serve to color the toner and/or render it more visible. Suitable toners can be prepared without the use of a colorant material where it is desired to have developed toner image of low optical densities. In those instances where it is desired to utilize a colorant, the colorants can, in principle be selected from virtually any of the compounds mentioned in the *Colour Index* Volumes 1 and 2, Second Edition. Included among the vast number of useful colorants are those dyes and/or pigments that are typically employed as blue, green, red and yellow colorants used in electrostatographic toners to make color copies. Suitable colorants include those typically employed in primary substrative cyan, magenta and yellow colored toners. Such dyes and pigments are well known in the art. One particularly useful colorant for toners to be used in black and white electrostatographic copying machines and printers is carbon black. The amount of colorant added may vary over a wide range, for example, from about 1 to 20 percent of the weight of binder polymer used in the toner. Good results are obtained when the amount is from about 1 to 10 percent. Mixtures of colorants can also be used.

Another component of the toner composition is a charge control agent. The term "charge control" refers to a propensity of a toner addendum to modify the triboelectric charging properties of the resulting toner. A very wide variety of charge control agents for positive charging toners are available. A large, but lesser number of charge control agents for negative charging toners is also available. Suitable charge control agents are also well known in the art. Charge control agents are generally employed in small quantities such as, from about 0.1 to about 5 weight percent based upon the weight of the toner. Mixtures of charge control agents can also be used.

The toner can also contain other additives of the type used in previous toners, including magnetic pigments, leveling agents, surfactants, stabilizers, and other addenda well known in the art. The total quantity of such additives can vary. A present preference is to employ not more than about 10 weight percent of such additives on a total toner powder composition weight basis. In the case of MICR (magnetic ink character recognition) toners, the weight percent of iron oxide could be as high as 40% by weight.

Toners can optionally incorporate a small quantity of low surface energy material, as described in U.S. Pat. No. 4,517,272 and 4,758,491. Optionally the toner can contain a particulate additive on its surface such as the particulate additive disclosed in U.S. Pat. No. 5,192,637.

The toner can also be surface treated with small inorganic particles to impart powder flow or cleaning or improved transfer. The transfer assisting particles typically are smaller than 0.4 microns. It is preferred that the transfer assisting particles are between about 0.01 and 0.2 microns, and it is most preferred that the transfer assisting particles are between about 0.05 and 0.1 microns. Preferred addenda are inorganic particles; however, organic particles can also be used. A mixture of two or more different types and sizes of transfer assisting particles can be used. The transfer assisting particles can be treated before or after adhering to the toner particles.

A developer can include a carrier and the described toner composition. Carriers can be conductive, non-conductive, magnetic, or non-magnetic. Carriers are particulate and can be glass beads; crystals of inorganic salts such as aluminum potassium chloride, ammonium chloride, or sodium nitrate; granules of zirconia, silicon, or silica; particles of hard resin such as poly(methyl methacrylate); and particles of elemental metal or alloy or oxide such as iron, steel, nickel, carborundum, cobalt, oxidized iron and mixtures of such materials. Examples of carriers are disclosed in U.S. Pat. Nos. 3,850,663 and 3,970,571. Especially useful in magnetic brush development procedures are iron particles such as porous iron, particles having oxidized surfaces, steel particles, and other "hard" and "soft" ferromagnetic materials such as gamma ferric oxides or ferrites of barium, strontium, lead, magnesium, or aluminum. Such carriers are disclosed in U.S. Pat. No. 4,546,060.

Carrier particles can be uncoated or coated with a thin layer of a film-forming resin to establish the correct triboelectric relationship and charge level with the toner employed. Examples of suitable resins are known in the art. Other useful resins are fluorocarbons such as polytetrafluoroethylene, poly(vinylidene fluoride), mixtures of these, and copolymers of vinylidene fluoride and tetrafluoroethylene. Polymeric fluorocarbon coatings can aid the developer to meet the electrostatic force requirements mentioned above by shifting the carrier particles to a position in the triboelectric series different from that of the uncoated carrier core material to adjust the degree of triboelectric charging of both the carrier and toner particles. The polymeric fluorocarbon coatings can also reduce the frictional characteristics of the carrier particles in order to improve developer flow properties; reduce the surface hardness of the carrier particles to reduce carrier particle breakage and abrasion on the photoconductor and other components; reduce the tendency of toner particles or other materials to undesirably permanently adhere to carrier particles; and alter electrical resistance of the carrier particles. Currently preferred is a mixture of poly(vinylidene fluoride) and poly(methyl methacrylate) as described for example in U.S. Pat. No. 4,590,140.

The carrier can be strontium ferrite coated with fluorocarbon on a 0.5 percent weight/weight basis, and treated with an aqueous solution of 4 weight percent KOH and 4 weight percent of a 2 parts by weight to 1 parts by weight mixture of $Na_2S_2O_8$ and $Na_2S_2O_5$ as disclosed in U.S. Pat. No. 5,411,832 of Yoerger, which is hereby incorporated herein by reference. The fluorocarbon carrier is also referred to as "modified KYNAR®". In a preferred embodiment, the carrier is sponge iron, which is sieved, oxidized and coated with fluorocarbon on a 0.2 weight percent basis.

In a particular embodiment, the developer contains from about 1 to about 20 percent by weight of toner and from about 80 to about 99 percent by weight of carrier particles. Usually, carrier particles are larger than toner particles. Conventional carrier particles have a particle size of from about 5 to about 1200 micrometers and are generally from 20 to 200 micrometers.

The developer can be made by simply mixing the described toner composition and the carrier in a suitable mixing device. The components are mixed until the developer achieves a maximum charge. Useful mixing devices include roll mills and other high energy mixing devices.

The scope of this invention is not limited by the particle size of the toner used. Typical toner particles generally have an average diameter in the range of about 0.1 to 100 $\mu$m, a value of about 2 to 20 $\mu$m being particularly useful in many current copy machines. The term "particle size" used herein, or the term "size", or "sized" as employed herein in reference to the term "particles", means the median volume weighted diameter as measured by conventional diameter measuring devices, such as a Coulter Multisizer, sold by Coulter, Inc. of Hialeah, Fla. Median volume weighted diameter is the diameter of an equivalent weight spherical particle which represents the median for a sample.

The following preparation and fusing techniques and examples are presented to further illustrate this invention. The invention has been described with particular reference to preferred embodiments thereof but it will be understood that variations and modifications can be effected within the spirit and scope of the invention.

EXAMPLES

EXPERIMENTAL

Polymer Binder Synthesis

An organic phase was prepared by combining divinyl benzene (1.40 grams), t-dodecanethiol (1.50 grams), along with azo-bis pentanenitrile (4 grams), styrene (160 grams), and butyl acrylate (40 grams). An aqueous phase was prepared by combining distilled water (400 grams), potassium dichromate ((0.10 grams), poly(n-methylaminoethanol)adipate (2 grams: as 20 grams of 10 weight/weight percent solution in distilled water), and LUDOX™ brand colloidal silica marketed by E. I. du Pont de Nemours (2 grams: as 4 grams of a 50 weight/weight percent dispersion in distilled water).

The organic and aqueous phases were emulsified using a high shear mixing device, a MICROFLUIDIZER™ marketed by Microfluidics Corp. of Newton, Mass. The resulting emulsion was placed in a three necked round bottom flask equipped with a mechanical stirrer, condenser, and nitrogen inlet. The flask was placed in a constant temperature bath at 77° C. for 16 hours under continuous stirring. The flask was then vented, flushed with argon and heated to 85° C. for another three hours. The resulting polymer was filtered, washed, and dried.

The polymer binder described above was used to prepare toner formulations by melt compounding method. Various carbonaceous substances, both of activated type as described above and the pigment type, separately or in combination, were added to the toner formulation given below:

| | |
|---|---|
| Polymer Binder | 47 grams |
| T-77 Hodagoya Chemical Co. (charge agent) | 1.25 grams |
| BLACK PEARLS 430 Carbon (colorant) | 3.5 grams |
| Activated Carbon* | 0.5–2 gram |

*Omitted in control toner

The above formulation was prepared with the following activated carbons:

| | |
|---|---|
| 1. | None (Control) |
| 2. | NUCHAR ® SA (Westvaco Corp) |
| 3. | NORIT ™ SA-2 (American Norit Co. Inc.) |
| 4. | DARCO (20–40 Mesh) (ICI Americas Inc.) |
| 5. | Activated Carbon (Aldrich Chemical Co. 16,155-1) |

-continued

| | |
|---|---|
| 6. | NORIT ™ RO-0.8 (American Norit Co. Inc.) |
| 7. | NORIT ™ RB-1 (American Norit Co. Inc.) |
| 8. | NORIT ™ SA-4 (American Norit Co. Inc.) |

The toner formulation was melt compounded at 150° C. on a 4-inch two-roll mill for 20 minutes. The melt slab was then removed from the rolls and coarse ground using a Wiley mill and finally pulverized in a TX fluid energy mill to yield a mean toner particle size of approximately 12 microns.

The toner was first allowed to stand undisturbed for 2 days in a capped toner bottle. The perception of styrene and sulfur or thiol-type odors were measured by sniffing the headspace over the toner immediately upon opening the toner bottle.

RESULTS & DISCUSSION

Results from the odor testing of the toner formulation described above with and without the inclusion of the activated carbons discussed above are summarized in the following table. All toners of the present invention contained 7 pph Black Pearls 430 pigment type carbon and 1,2, or 4 pph of activated carbon as an additive.

| SAMPLE | Carbon Pigment | ADDITIVE | ODOR RESPONSE* |
|---|---|---|---|
| Comparative Ex. 1 | 7 pph BLACK PEARLS 430 | None | Strong |
| Comparative Ex. 2 | 7 pph REGAL 330R | None | Strong |
| Comparative Ex. 3 | 7 pph REGAL 660R | None | Strong |

| SAMPLE | Carbon Pigment | ADDITIVE | ODOR RESPONSE* |
|---|---|---|---|
| Comparative Ex. 4 | 7 pph RAVEN 850 | None | Strong |
| Comparative Ex. 5 | 7 pph RAVEN 1255 | None | Strong |
| Comparative Ex. 6 | 7 pph ELFTEX 8 | None | Strong |
| Example 1 | 7 pph BL. PEARLS 430 | 1 pph NORIT ™ SA-2 | Slight |
| Example 2 | 7 pph BL. PEARLS 430 | 2 pph NORIT ™ SA-2 | None |
| Example 3 | 7 pph BL. PEARLS 430 | 4 pph NORIT ™ SA-2 | None |
| Example 4 | 7 pph BL. PEARLS 430 | 1 pph NORIT ™ SA-4 | Slight |
| Example 5 | 7 pph BL. PEARLS 430 | 2 pph NORIT ™ SA-4 | None |
| Example 6 | 7 pph BL. PEARLS 430 | 4 pph NORIT ™ SA-4 | None |
| Example 7 | 7 pph BL. PEARLS 430 | 1 pph DARCO (20–40 Mesh) | Slight |
| Example 8 | 7 pph BL. PEARLS 430 | 2 pph DARCO (20–40 Mesh) | None |
| Example 9 | 7 pph BL. PEARLS 430 | 4 pph DARCO (20–40 Mesh) | None |
| Example 10 | 7 pph BL. PEARLS 430 | 1 pph NORIT ™ RO 0.8 | Slight |
| Example 11 | 7 pph BL. PEARLS 430 | 2 pph NORIT ™ RO 0.8 | None |
| Example 12 | 7 pph BL. PEARLS 430 | 4 pph NORIT ™ RO 0.8 | None |
| Example 13 | 7 pph BL. PEARLS 430 | 1 pph ALDRICH Activated Carbon | Slight |
| Example 14 | 7 pph BL. PEARLS 430 | 2 pph ALDRICH Activated Carbon | None |
| Example 15 | 7 pph BL. PEARLS 430 | 4 pph ALDRICH Activated Carbon | None |
| Example 16 | 7 pph BL. PEARLS 430 | 1 pph NORIT ™ RB-1 | Slight |
| Example 17 | 7 pph BL. PEARLS 430 | 2 pph NORIT ™ RB-1 | None |
| Example 18 | 7 pph BL. PEARLS 430 | 4 pph NORIT ™ RB-1 | None |
| Example 19 | 7 pph BL. PEARLS 430 | 1 pph NUCHAK ® | Slight |
| Example 20 | 7 pph BL. PEARLS 430 | 2 pph NUCHAK ® | None |
| Example 21 | 7 pph BL. PEARLS 430 | 4 pph NUCHAK ® | None |

*Any perceived odors, e.g., styrene- or sulfur-type etc., emanating from toner.

As indicated above there is considerable reduction in the malodor response from the toner formulations which contain the activated carbon additives. The control toner as described in Comparative Example 1 through 6 had a noticeably disagreeable odor particularly in the thiol component. The level of odor reduction is dependent upon the amount of activated carbon used and appeared to be independent of the specific type of active carbon chosen. All the active carbons tried in the present experiments appeared to be effective in completely eliminating objectionable toner odors. Best results were obtained with at least 2pph activated carbon in the toner matrix. Although levels of 4pph eliminate odor from the toner most activated carbons caused increased developer dusting at levels above 5 pph and thus this may serve as a preferred upper limit for activated carbon incorporation. The NORIT™ SA-2 carbon displayed the least increase in dusting at 5 pph and thus is a preferred embodiment of this invention. None of the activated carbons were observed to impact toner charging characteristics in any way relative to the control performance.

Particle size of the activated carbon is quite important in this invention with small size being advantageous (volume average particle size 1$\mu$ or less). Most active carbons are much larger in volume average particle size than 1$\mu$ and can be difficult to compound into the toner binder. This may be the cause for the high dusting at elevated activated carbon levels in the above formulations. The dust is perhaps unincorporated large particles of activated carbon. Pregrinding of the active carbons by known methodology may be necessary to obtain a suitable particle size distribution for the active carbon.

The examples of active carbons reported here which were effective in our invention are not exhaustive. We envision that active carbons prepared from a wide variety of substrates (with vegetable matter, wood or peat preferred) and activated by an oxidative process yielding polar functionalities on the carbon surface will generally be effective in this invention.

The invention has been described in detail with particular reference to certain preferred embodiments thereof, but it will be understood that variations and modifications can be effected within the spirit and scope of the invention.

We claim:

1. A method of preparing an odor-free toner comprising the steps of:

a) forming fine particles of activated carbon, said fine particles having a volume average particle size of 1 micrometer or less;

b) mixing a binder polymer, carbon black, and said activated carbon fine particles;

c) melt blending the polymer, carbon black and said activated carbon fine particles to achieve a uniformly blended melt product;

d) cooling the melt product; and e) pulverizing the melt product to a desired volume average particle size;

wherein the weight ratio of activated carbon:carbon black is from 1:7 to 4:7.

2. The method of claim 1 wherein the melt product of d) is ground before being pulverized in step e) in claim 1.

3. The method of claim 1 wherein the amount of activated carbon is about 1 to 5 weight percent of the total toner weight.

4. The method of claim 3 wherein the amount of activated carbon is about 1 to 2 weight percent of the total toner weight.

5. The method of claim 1 wherein melt blending is carried out at a temperature of about 70° C. to about 250° C.

6. The method of claim 1 wherein melt blending is carried out for about 1 to about 60 minutes.

7. The method of claim 1 wherein melt blending is carried out for 1 to 20 minutes.

8. The method of claim 1 wherein the melt product is pulverized to a volume average particle size of 5 to 20 micrometers.

9. The method of claim 1 wherein the melt product is pulverized to a volume average particle size of 7 to 14 micrometers.

10. The method of claim 1 wherein the weight ratio of activated carbon:carbon black is 1:7.

11. The method of claim 1 wherein said forming the fine particles of activated carbon comprises dispersing or milling activated carbon in a dispersant or a molten polymer matrix to form a dispersion of fine particles.

12. A toner made by the method described in claim 1.

13. A toner comprising a binder polymer, carbon black particles and activated carbon particles, said active carbon particles have a volume average particle size of 1 micrometer or less; wherein the carbon black particles and activated carbon particles are uniformly blended in the binder polymer and the weight ratio of activated carbon:carbon black is from 1:7 to 4:7.

14. The toner of claim 13 wherein the binder polymer is associated with compounds selected from the group consisting of thiols, sulfide compounds, vinyl compounds, styrene compounds, acrylate compounds, and methacrylate compounds.

15. The toner of claim 13 wherein the binder polymer comprises an addition polymerized vinyl polymer or a condensation polymer.

16. The toner of claim 15 wherein the binder polymer comprises polyester or copolyester.

* * * * *